US006129307A

United States Patent [19]

Deoms et al.

[11] Patent Number: 6,129,307

[45] Date of Patent: Oct. 10, 2000

[54] STABILIZED OPTICAL GIMBAL ASSEMBLY

[75] Inventors: James H. Deoms, Glenarm; Robert A. Hale; Robert W. Stahl, both of Ellicott City, all of Md.

[73] Assignee: Northrop Grumman Corporation, Los Angeles, Calif.

[21] Appl. No.: 07/754,771

[22] Filed: Sep. 4, 1991

[51] Int. Cl.[7] ..... F41G 7/00

[52] U.S. Cl. ..... 244/3.16; 356/149

[58] Field of Search ..... 359/196–198, 359/362, 363, 554–557; 356/134, 152, 138, 141, 149, 248; 250/201.1, 201.9, 203.1–203.6, 236, 338.1; 358/109, 210; 244/3.16

[56] References Cited

U.S. PATENT DOCUMENTS 4,085,910 4/1978 Baker et al. ..... 356/149
4,087,061 5/1978 Burt ..... 359/557
4,208,087 6/1980 Cooper et al. ..... 359/557
4,316,649 2/1982 Alvarez et al. ..... 359/556
4,404,592 9/1983 Pepin et al. ..... 356/149

*Primary Examiner*—Mark Hellner

[57] ABSTRACT

A two axis optical FLIR gimbal assembly for azimuth and elevation supporting an assembly of optical elements including five folding mirrors, one of which is a Mangin mirror, and six lenses which implement a wide stabilized field of regard and provide a magnification of the incident image. The gimbal assembly, moreover, includes a yoke structure which is driven about an azimuth axis and supports a stable body member which is independently driven about an elevation axis. An independently driven turret is also rotatable about the azimuth axis and shields the gimbal assembly from external forces such as an air stream passing over the fuselage of an aircraft.

15 Claims, 4 Drawing Sheets

STABILIZED OPTICAL GIMBAL ASSEMBLY

CROSS REFERENCE TO RELATED APPLICATION

This application is related to the following application which is assigned to the assignee of this invention:

"Optically Multiplexed Dual Line of Sight FLIR System", U.S. Ser. No. 07/754,777 (W.E. 57,082), filed on Sep. 4, 1991.

BACKGROUND OF THE INVENTION

This invention relates generally to optical imaging systems located on a platform, for example an aircraft, and more particularly to a stabilized optical gimbal assembly used in connection with a forward looking infrared target acquisition and tracking apparatus utilized in weapons delivery systems.

Sophisticated optical imaging systems normally require some sort of sealed enclosure, particularly when exposed to the elements. When the optical imaging system is mounted on an aircraft, particularly high performance military aircraft, it is extremely important to keep the size of the sealed enclosure as small as possible in order to minimize the aerodynamic effects on the aircraft. The enclosure inherently includes some type of window through which the internal optical system can view the outside world. In order to increase system efficiency, it is necessary to make this window as large as possible in order to maximize the amount of light that can be collected for imaging and is referred to as the "clear aperture" and is one of the most important parameters in determining system performance. Accordingly, one of the major problems in any system design is to maximize the clear aperture size in the smallest possible enclosure. In other words, one attempts to maximize the ratio of clear aperture diameter to enclosure diameter or some other maximum dimension.

The optics, moreover, are normally mounted on a stabilized gimbal located just inside the window. The gimbal directs the line of sight of the optical system in azimuth and/or elevation relative to aircraft coordinates, thereby generating what is referred to as the "field of regard" of the system. The larger the field of regard, the better. Where the system is used to track targets for a weapons system, the gimbal must also be well stabilized so that any jitter in the image displayed to the operator is eliminated. All of this requires motors, resolvers, gyros, bearings, well known to those skilled in the art which complicate the problem of maximizing the ratio of clear aperture to enclosure diameter.

Gimbal enclosures are typically referred to as shrouds or turrets. As a result, one attempts to maximize the ratio of the clear aperture diameter as measured at the outside surface of the windows to the turret outside diameter. Many different optical gimbal schemes have been previously designed in an effort to maximize the ratio of clear aperture diameter to turret outside diameter but have been known to achieve a ratio only on the order of 0.50.

SUMMARY

Accordingly, it is the primary object of the present invention to provide an improvement in stabilized gimbal mounted optical image systems.

It is another object of the invention to provide an improvement in stabilized gimbal optical systems enclosed in a turret.

And it is yet another object of the invention to provide an improvement in stabilized gimbal optical systems for maximizing the ratio of the clear aperture diameter to the turret outside diameter.

Briefly, the foregoing and other objects are achieved by a two axis gimbal assembly for azimuth and elevation which supports an assembly of optical elements including five folding mirrors, one of which is a Mangin mirror, and six lenses which implement a wide stabilized field of regard and provide a magnification of the incident image. The gimbal assembly, moreover, includes a yoke structure which is driven about an azimuth axis and supports a stable body member which is independently driven about an elevation axis. An independently driven turret is also rotatable about the azimuth axis and shields the gimbal assembly from external forces such as an air stream passing over the fuselage of an aircraft.

BRIEF DESCRIPTION OF THE DRAWINGS

The following detailed description of the invention will be more readily understood when considered in light of the accompanying drawings wherein.

DETAILED DESCRIPTION OF THE INVENTION

Figure 1:
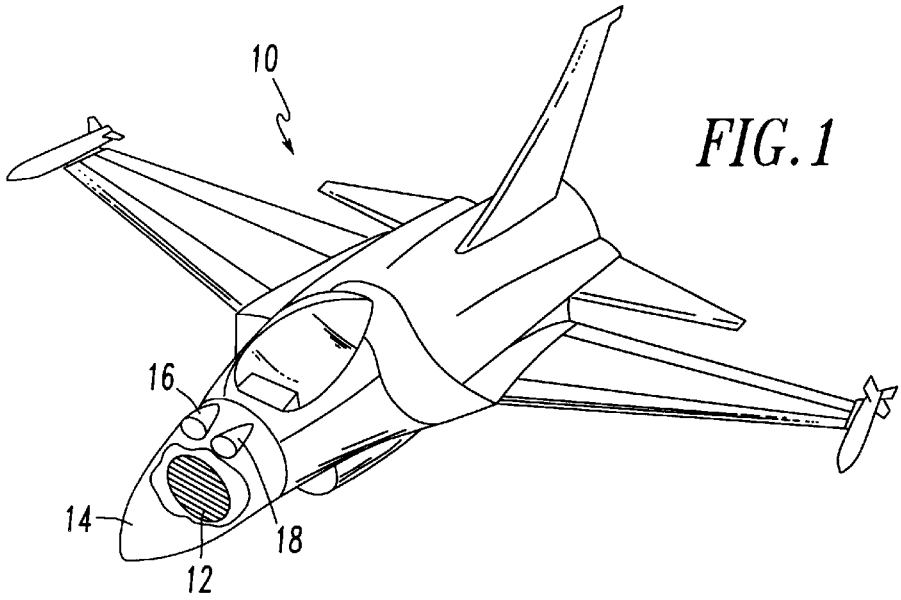
FIG. 1 is a perspective view of an aircraft which acts as a platform for the subject invention.

Referring now to the drawings wherein like reference numerals refer to like components throughout, reference is first made to FIG. 1 wherein there is shown an aircraft 10 which in addition to having a radar system generally denoted by reference numeral 12 located in the nose portion 14 thereof, also includes a pair of forward looking infrared (FLIR) turrets 16 and 18 which are used in conjunction with the radar system 12 to provide both a navigation (pilotage) and a weapons delivery guidance (targeting) function or mode in a single integrated system which is shown and described in the above-referenced related application entitled, "Optically Multiplexed Dual Line of Sight FLIR System", U.S. Ser. No. 07/745,777 and which is incorporated herein by reference.

Figure 2:
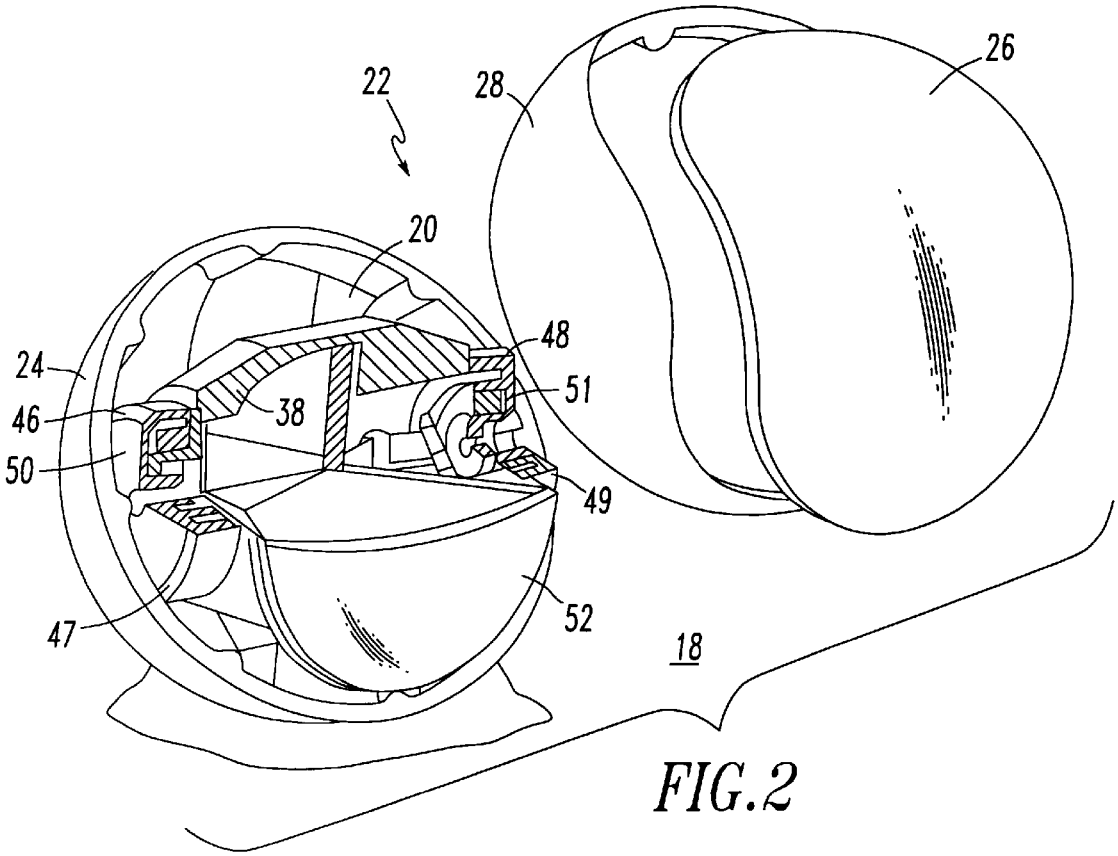
FIG. 2 is an exploded perspective view generally illustrative of the invention.

One of the turrets 18 which is used for targeting, for example, includes an optical gimbal system, the details of which are shown in FIGS. 2 through 7. More particularly, and as shown in FIG. 2, the turret 18 used for targeting is comprised of a stabilized gimbal assembly 20 which acts as a mount for a compact lens and mirror configuration, to be explained hereinafter, located in a mechanical turret structure 22 and which includes a turret housing 24 and a front window 26 which is mounted on a frame 28 fastened to the housing 24.

The housing 24 defines a portion of a sphere while the front window 26 and frame 28 defines another portion of the same sphere. Moreover, the front window 26 is curvilinear and is of a size so as to provide a clear aperture C.A. of a predetermined diameter dimension, for example, as shown in FIG. 5, relative to the diameter of the housing or turret 24 such that the ratio of the clear aperture diameter dimension to the turret diameter dimension is relatively large, e.g. 0.69. The front window 26 as configured in FIG. 2 provides a field of regard along an elevation axis 40 (FIG. 4) of, for example, 10° down and 70° up relative to a 0° elevation direction.

Figure 3:
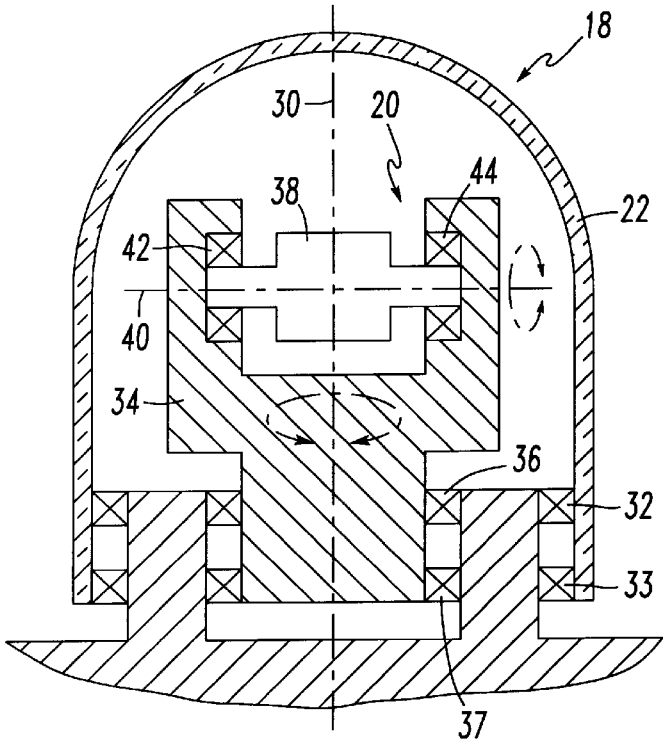
FIG. 3 is a mechanical schematic diagram generally illustrative of the subject invention and being in the form of a central vertical cross section thereof.

Prior to discussing the details of the gimbal assembly 20, reference will first be made to FIG. 3 which broadly sets forth the concept of a gimbal assembly 20, not only being shielded from the external forces of the air stream by the turret 22 but also being independently rotatable therein. As shown, the turret 18 is rotatable about an azimuth axis 30 on a set of bearings 32 and 33, and by a turret drive assembly, not shown. The gimbal assembly 20 is comprised of two major components, a yoke 34 which is mounted on another set of bearings 36 and 37, and which is independently rotatable about the azimuth axis 30, and a structure 38 which is referred to as a stable body and which is mounted on the yoke 34 and being independently rotatable about an elevation axis 40 by means of bearings 42 and 44.

Figure 4:
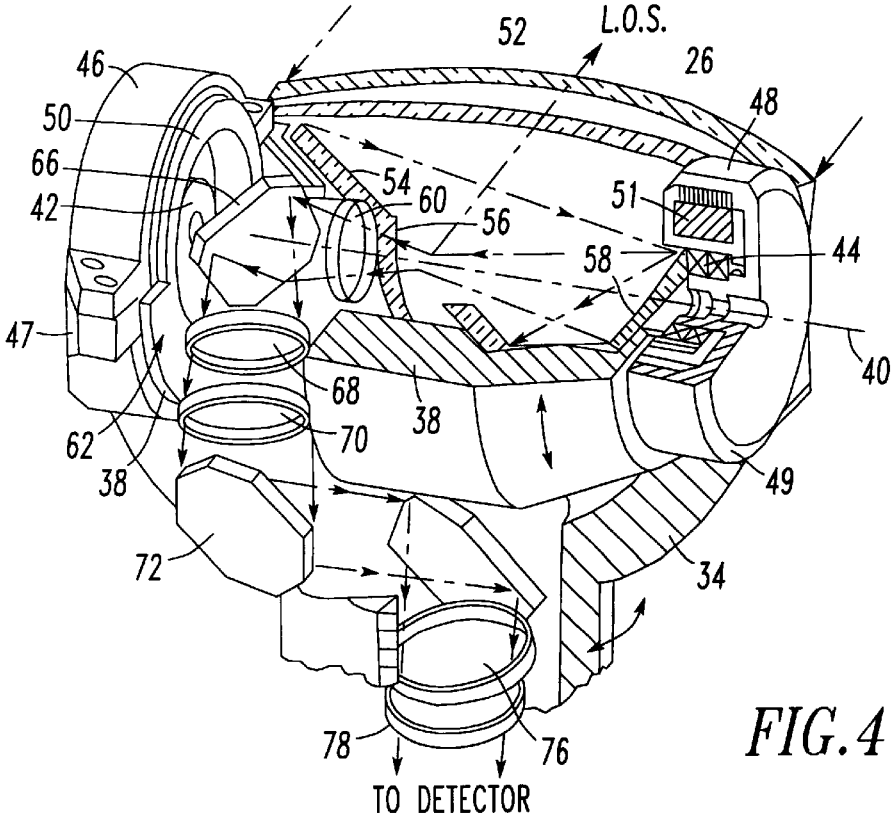
FIG. 4 is a perspective view partially cut away of the optical elements included in a preferred embodiment of the invention.
Figure 6:
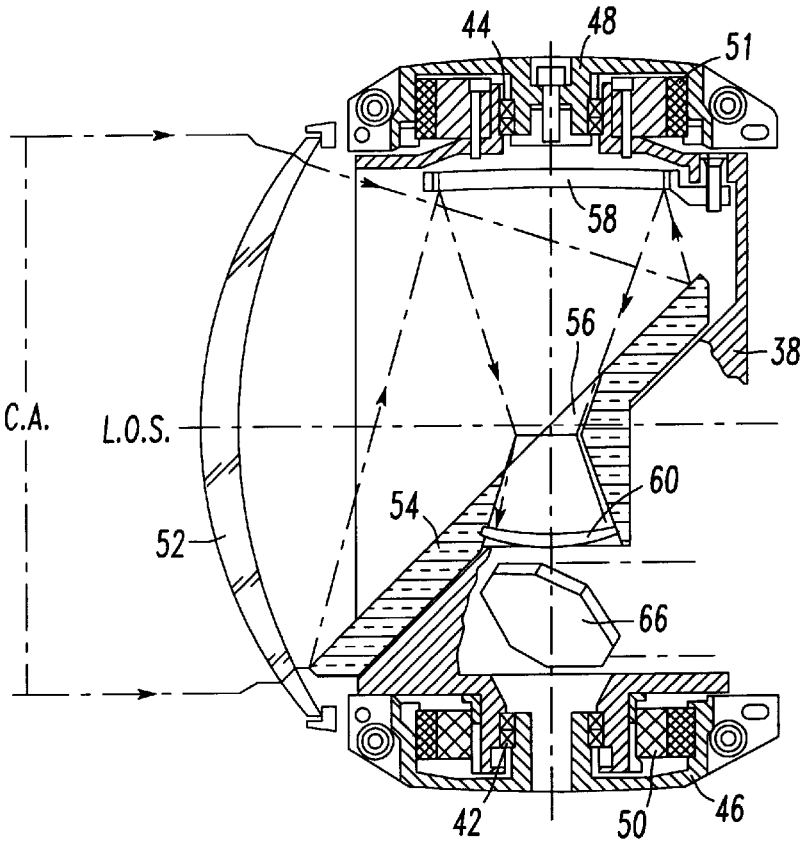
FIG. 6 is an enlarged sectional view of FIG. 5 taken along the lines 6—6 thereof.
Figure 5:
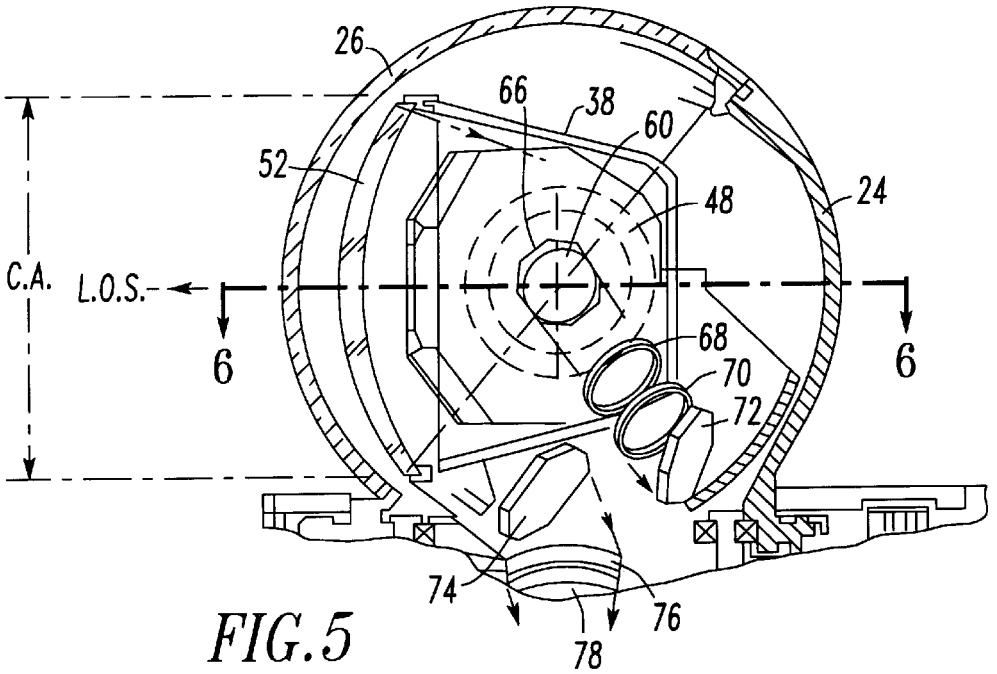
FIG. 5 is a side planar view of a central vertical cross section of the embodiment shown in FIG. 4.

Referring now to FIG. 4, shown thereat is the three dimensional relationship of the optics included in the subject invention and which is further disclosed in FIGS. 5 and 6. Collectively, these figures illustrate a spherically shaped window 26 (FIG. 2) behind which is mounted the stable body member 38 and which is rotatable around the elevation axis 40 while being held in place by the yoke 34 The yoke 34 additionally includes a pair of upper semi-circular support ring segments 46, 48 and a pair of lower support ring segments 47, 49 (FIG. 7) which support and hold the bearings 42 and 44 as well as the components of a pair of drive motor and resolver assemblies 50 and 51.

Figure 7:
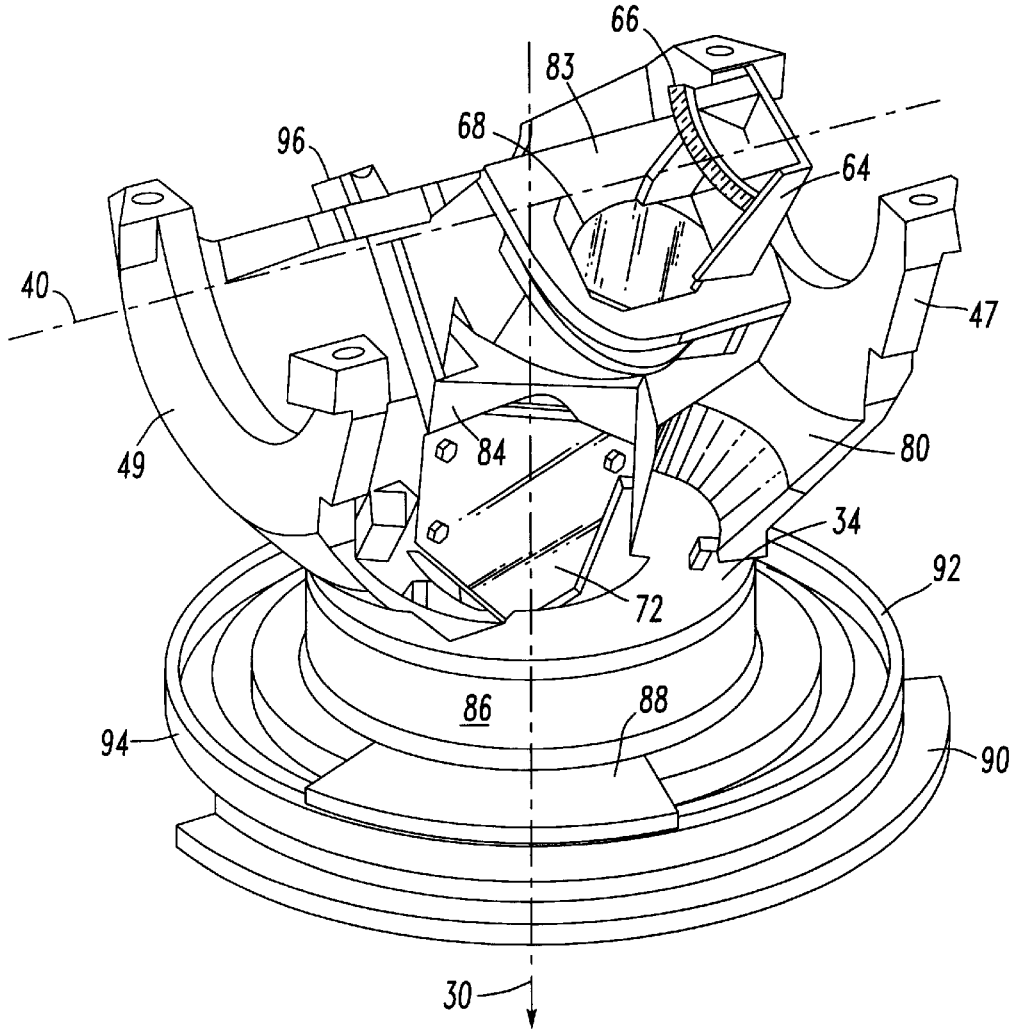
FIG. 7 is a perspective view further illustrative of the preferred embodiment of the invention.

The physical construction of the yoke structure 34 is shown in FIG. 7 and will be referred to subsequently. The stable body member 38 comprises a semi-cylindrical structure to which is secured a generally circular front lens 52 comprised of material which readily passes infrared energy and which is located immediately behind the window 26. Also mounted thereon is an angulated mirror 54 (FIG. 6) having an aperture 56 at the center. A second mirror 58 is also mounted on the stable body and is located to the side and adjacent the mounting ring 48. The mirror 58 comprises a well known Mangin mirror and reflects energy through the aperture 56 to a second relatively smaller lens 60 which is also mounted on the stable body 38 and located behind the mirror 54 and orthogonal to the elevation axis 40. The two lenses 52 and 60 and the two mirrors 54 and 58 being mounted solidly on the stable body 38 are adapted to rotate about the axis 40 elevation.

The stable body 38, moreover, is designed to have a peripheral slot 62 which accommodates an upwardly extending support structure 64 (FIG. 7) on the yoke 34 which supports a third mirror element 66, a pair of lenses 68 and 70, fourth and fifth mirrors 72 and 74, and a pair of output lenses 76 and 78 as best shown in FIG. 4. These elements rotate only in azimuth and not in elevation.

The three mirrors 66, 72 and 74 are comprised of generally flat faced reflectors which are tilted and angulated downwardly and operate in combination with the mirrors 54 and 58 to fold the received optical energy in an extremely compact gimbal package. Such an arrangement provides a magnification on the order of x11 of the incident image on the front lens 52.

Referring now briefly to FIG. 7, a support structure 80 including the lower semi-circular support members 47 and 49 to which the upper semi-circular support rings 46 and 48 (FIG. 4) attach is shown further including an upwardly extending mirror support member 64 for member 66 located adjacent the support ring 47 and on which is secured a generally flat apertured plate member 83 which supports and holds the lens 68. The lens 70 (FIG. 4) is located beneath the lens 68 where it directs optical energy to the mirror 72 which is shown from its rear side and being secured to a support member 84. The fifth mirror 74 and the two output lenses 76 and 78 are not shown but are located within a circular base 86.

Below the base 86 are several circular members 88 and 90 which operate as balance weights while the member 92 constitutes a shaft element for a motor rotor 94 which is adapted to rotate the yoke 34 around the azimuth axis 30. Behind the mirror and lens support structure 84 is shown a turret bumper stop member 96 which is adapted to restrict rotation of the yoke 34 around the azimuth axis 30 relative to the turret rotation.

Thus what has been shown and described is an imaging gimbal assembly which is adapted to have a ratio of clear aperture diameter to turret diameter on the order of 0.69 with field of regard in elevation from 10° down and 70° up relative to a 0° elevation (normal forward) direction, while the azimuth field of view can be made 360°, when desirable.

While the subject invention is particularly applicable to being mounted on an aircraft, it should be noted that the invention is applicable to any operational environment which requires a stabilized optical gimbal having the largest possible clear aperture diameter for a given turret diameter. It can also be used for systems with any optical wavelength and may be utilized on ground vehicles, ships and even stationary applications, both military and non-military.

Having thus shown and described what is at present to be the preferred embodiment of the invention, it should be noted that the same has been made by way of illustration and not limitation. Accordingly, all modifications, alterations and changes coming within the spirit and scope of the invention are herein meant to be included.

What is claimed is:

1. A stabilized optical gimbal assembly, comprising;

turret means including a relatively large aperture rotatable about a first axis;

a yoke located within the turret means and being independently rotatable about said first axis;

a stable body member mounted on and supported by the yoke and being independently rotatable about a second axis orthogonal to said first axis;

a first lens mounted across a forward portion of the stable body member and being oriented toward a predetermined line of sight;

a first mirror having a central aperture mounted on the stable body member behind the front lens and angulated relative thereto;

a second mirror mounted on said stable body member to one side thereof and adjacent said first mirror for receiving optical energy reflected therefrom and directing said optical energy through said central aperture;

a second lens mounted on said stable body member behind said first mirror and aligned with said central aperture;

a third mirror mounted on said yoke in alignment with said second lens and angulated relative thereto for receiving optical energy from said second lens and directing said energy through an opening in a rear portion of the stable body;

a first lens assembly located in said opening for receiving optical energy from said third mirror;

a fourth mirror angularly mounted on said yoke behind said stable body member for receiving optical energy from said first lens assembly;

a fifth mirror angularly mounted on said yoke beneath said stable body member for receiving optical energy from said fourth mirror;

and a second lens system mounted on said yoke for receiving optical energy from said fifth mirror and directing optical energy out of the gimbal assembly.

2. The gimbal assembly as defined by claim 1 wherein said second mirror comprises a Mangin mirror.

3. The gimbal assembly as defined by claim 2 and additionally including a support structure on said yoke and extending into said opening of the stable body member for supporting said third mirror, said at least one third lens, and said fourth and fifth mirrors.

4. The gimbal assembly as defined by claim 3 wherein said first axis comprises an azimuth axis and wherein said second axis comprises an elevation axis.

5. The gimbal assembly as defined by claim 4 wherein said yoke comprises an upright member whereby said third mirror, said first lens assembly, and said fourth and fifth mirrors rotate only about said azimuth axis while said first and second lenses and said first and second mirrors rotate about said elevation axis.

6. The gimbal assembly as defined by claim 5 wherein said stable body member comprises a cylindrical type structure mounted on and held in place on said yoke by opposing pairs of upper and lower semi-circular support ring segments.

7. The gimbal assembly as defined by claim 6 wherein said pairs of upper and lower support ring segments additionally support drive motor means for rotating said stable body member.

8. The gimbal assembly as defined by claim 7 and additionally including drive motor means for rotating said yoke.

9. The gimbal assembly as defined by claim 8 wherein said first lens assembly comprises a pair of lenses.

10. The gimbal assembly as defined by claim 9 wherein said second lens assembly comprises a pair of lenses.

11. The gimbal assembly as defined by claim 1 wherein said turret means includes a housing and a front window attached to said housing, and wherein said first lens is located directly behind said window.

12. The gimbal assembly as defined by claim 11 and additionally including a frame for attaching said window to said housing.

13. The gimbal assembly as defined by claim 12 wherein said housing defines a portion of a sphere and said front window and frame define another portion of a sphere.

14. The gimbal assembly as defined by claim 13 wherein said first axis comprises an azimuth axis and said second axis comprises an elevation axis and said front window includes a length dimension along said azimuth axis which is greater than a width dimension along said elevation axis.

15. The gimbal assembly as defined by claim 14 wherein said front window is curvilinear and includes a predetermined clear aperture diameter dimension relative to a diameter dimension of said housing.

* * * * *